US009867459B2

(12) United States Patent
Calderone

(10) Patent No.: US 9,867,459 B2
(45) Date of Patent: Jan. 16, 2018

(54) RETRACTABLE SOFA TABLE

(71) Applicant: Joel Calderone, Long Beach, CA (US)

(72) Inventor: Joel Calderone, Long Beach, CA (US)

( * ) Notice: Subject to any disclaimer, the term of this patent is extended or adjusted under 35 U.S.C. 154(b) by 160 days.

(21) Appl. No.: 14/802,195

(22) Filed: Jul. 17, 2015

(65) Prior Publication Data

US 2016/0000222 A1 Jan. 7, 2016

Related U.S. Application Data

(63) Continuation-in-part of application No. 14/258,283, filed on Apr. 22, 2014, now Pat. No. 9,345,320.

(51) Int. Cl.

| | |
|---|---|
| ***A47B 23/00*** | (2006.01) |
| ***A47C 7/70*** | (2006.01) |
| ***A47C 21/00*** | (2006.01) |

(52) U.S. Cl.

CPC ..... *A47B 23/00* (2013.01); *A47C 7/70* (2013.01); *A47C 21/00* (2013.01)

(58) Field of Classification Search

CPC ..... A47C 21/00; A47C 31/00; A47C 7/70; A47C 7/68; A47C 7/62; A61G 7/05; A61G 7/0503; A47B 23/00; A47B 23/02; A47B 23/025; A47B 23/046; F16M 13/02; F16M 13/00; F16M 11/10; F16M 11/06; F16M 11/04

USPC ..... 5/507.1, 503.1–506.1, 658; 108/49, 42; 297/144, 145

See application file for complete search history.

(56) References Cited

U.S. PATENT DOCUMENTS

| | | | | | |
|---|---|---|---|---|---|
| 912,936 | A | * | 2/1909 | Cowdrey | A47B 5/04 108/135 |
| 915,651 | A | | 3/1909 | Appel | |
| 1,028,932 | A | * | 6/1912 | Collins | A47B 27/02 108/10 |
| 1,043,638 | A | | 11/1912 | Sneed | |
| 1,208,979 | A | | 12/1916 | Kahre | |
| 1,231,678 | A | | 7/1917 | Walker | |
| 1,248,842 | A | | 12/1917 | Gaver | |
| 1,312,274 | A | | 8/1919 | Sculthorpe | |
| 1,662,675 | A | | 3/1928 | Innes | |
| 1,862,237 | A | | 6/1932 | Pepler | |
| 1,869,444 | A | | 8/1932 | Tobey | |
| 1,891,691 | A | | 12/1932 | Runkles | |
| 2,460,244 | A | | 1/1949 | Lewis | |
| 2,518,381 | A | | 8/1950 | Runkles | |
| 2,612,422 | A | | 9/1952 | Sarkus | |
| 2,635,680 | A | | 4/1953 | Zentmire | |
| 2,678,792 | A | * | 5/1954 | Gallion et al. | A47B 23/02 108/141 |
| 2,845,113 | A | | 7/1958 | Keel | |
| 3,543,312 | A | | 12/1970 | Pofferi | |
| 3,583,760 | A | | 6/1971 | McGregor | |
| 3,618,145 | A | | 11/1971 | Rowe | |
| 3,632,161 | A | | 1/1972 | Arfaras et al. | |
| 3,717,375 | A | | 2/1973 | Slobodan | |
| 4,834,449 | A | | 5/1989 | Engelman | |

(Continued)

*Primary Examiner* — Robert G Santos
(74) *Attorney, Agent, or Firm* — Fulwider Patton LLP

(57) ABSTRACT

Elongated vertical stem to pivotally attached on one extremity to the frame of the sofa arm rest and pivotally mounting a table on the free extremity for rotating between a retracted position disposed in the extended plane of the stem and a working position perpendicular to the plane of the stem.

21 Claims, 10 Drawing Sheets

(56) References Cited

U.S. PATENT DOCUMENTS

| | | | | |
|---|---|---|---|---|
| 4,944,552 | A | 7/1990 | Harris | |
| 5,035,464 | A | 7/1991 | Spallholtz | |
| 5,129,702 | A | 7/1992 | Ervin et al. | |
| 5,547,247 | A | 8/1996 | Dixon | |
| 5,927,799 | A | 7/1999 | Tornero | |
| 6,220,658 | B1 | 4/2001 | Lukawski et al. | |
| 7,201,439 | B2 | 4/2007 | Schweizer | |
| 7,234,182 | B2 | 6/2007 | Miller et al. | |
| 7,509,696 | B2 | 3/2009 | Soto et al. | |
| 7,798,072 | B2 | 9/2010 | Becker et al. | |
| 7,874,614 | B2 | 1/2011 | Figueras Mitjans et al. | |
| 8,474,384 | B2 | 7/2013 | Sundarrao | |
| 9,345,320 | B2 * | 5/2016 | Calderone ..... | A47B 23/025 |
| 2005/0258672 | A1 | 11/2005 | Schweizer | |
| 2006/0085917 | A1 | 4/2006 | Miller | |
| 2006/0220425 | A1 | 10/2006 | Becker et al. | |
| 2006/0288482 | A1 | 12/2006 | Soto et al. | |
| 2009/0026812 | A1 | 1/2009 | Figueras Mitjans | |
| 2011/0067606 | A1 | 3/2011 | Sundarrao | |
| 2015/0296977 | A1 | 10/2015 | Calderone | |
| 2016/0000222 | A1 | 1/2016 | Calderone | |
| 2016/0058177 | A1 * | 3/2016 | Calderone ..... | A47B 23/025 5/507.1 |

* cited by examiner

FIG. 15
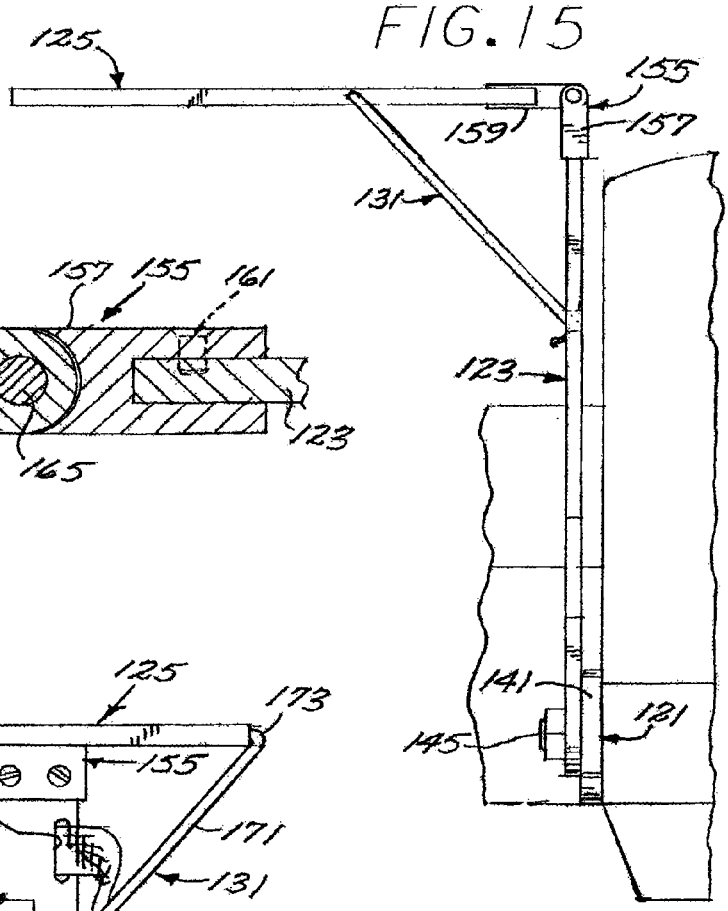
FIG. 13
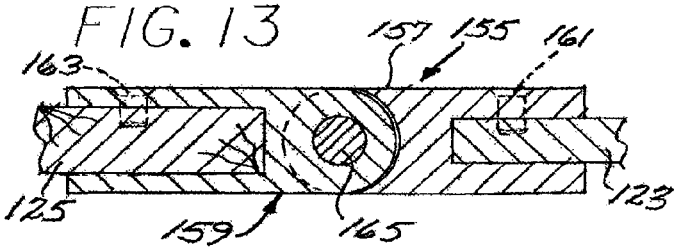
FIG. 14
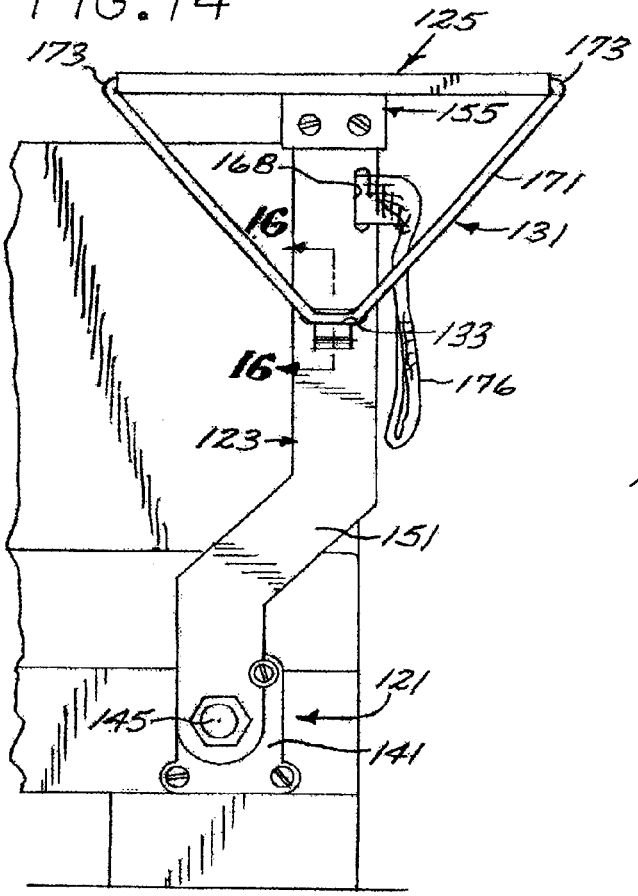
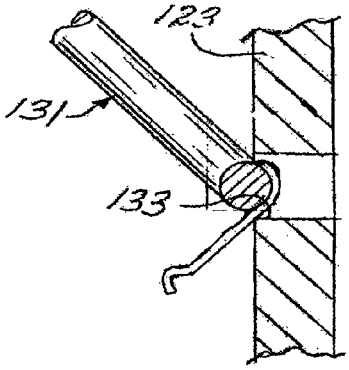
FIG. 16

RETRACTABLE SOFA TABLE

CROSS-REFERENCE TO RELATED APPLICATIONS

This application is a continuation-in-part of co-pending U.S. Ser. No. 14/258,283 filed Apr. 22, 2014, the entire contents of which are incorporated by reference herein and priority is claimed thereto.

BACKGROUND

The present invention relates to a retractable table for mount in a sofa or easy chair or the like.

DESCRIPTION OF THE PRIOR ART

Numerous different devices have been proposed for supporting a snack tray or the like for access by a user sitting on a sofa, easy chair or lying in bed. It has been proposed to provide a slider track on the inside surface of a sofa arm underneath the support frame for supporting an arm to be slid out from underneath the frame. The arm carries on its distal end a specialized ball joint so a support arm can be swiveled from a horizontal to a vertical position, the support arm further including a ball joint at the top extremity to support a folding tray. The slide arm may thus be slid outwardly and the support arm raised to support the tray in its working position. The arms may then be folded on one another and the tray folded to be recessed beneath the sofa frame. A device of this type is shown in U.S. Pat. No. 5,035,464 to Spallholtz. Such devices are of rather complex construction, relatively expensive to manufacture and subject to challenges in operation and, furthermore, leave the table exposed underneath the sofa for viewing by family members and guests and exposed to unsanitary conditions.

An accepted approach in the art has been to employ support devices incorporating a foot like extension to hook underneath the front or side edge of a chair. Devices of this type are shown in U.S. Pat. No. 3,717,375 to Slobodan. U.S. Pat. No. 8,113,128 to Lee and U.S. Patent Application Publication No. 2014/0020605 to Barrie. Such devices have not generally gained favor in the marketplace due to the fact that they leave the tray exposed unless a storage closet or the like is convenient to the user when the device is not in use. Other efforts have led to the proposal that the support be supported from a journal installed beneath the support frame of a chair to rotate a table into position over the lap of the user. A device of this type is shown in U.S. Pat. No. 5,765,911 to Sorenson. Again, these devices then leave an unsightly mechanism exposed both when the table is in use and in storage.

SUMMARY OF THE INVENTION

The invention includes a mounting bracket to mount forwardly on the support frame between the frame and a sofa arm or bed rail. An elongated stem is connected on one end to the one extremity to the bracket and terminates in a free extremity. A table is carried pivotally from the free extremity to pivot between a retracted position disposed in the extended plane of the stem and a working position disposed perpendicularly to the plane of the stem and a latch to latch the table in its working position.

BRIEF DESCRIPTION OF THE DRAWINGS

FIG. 13 is a horizontal, sectional view, in enlarged scale, taken along the lines 13-13 of FIG. 10;

FIG. 14 is a sectional view similar to FIG. 10 but depicting the stem in its vertical position; and FIG. 15 is a partial vertical, sectional view, in enlarged scale.

FIG. 16 is a detail view of a latch.

DETAILED DESCRIPTION OF THE PREFERRED EMBODIMENTS

Figure 1:
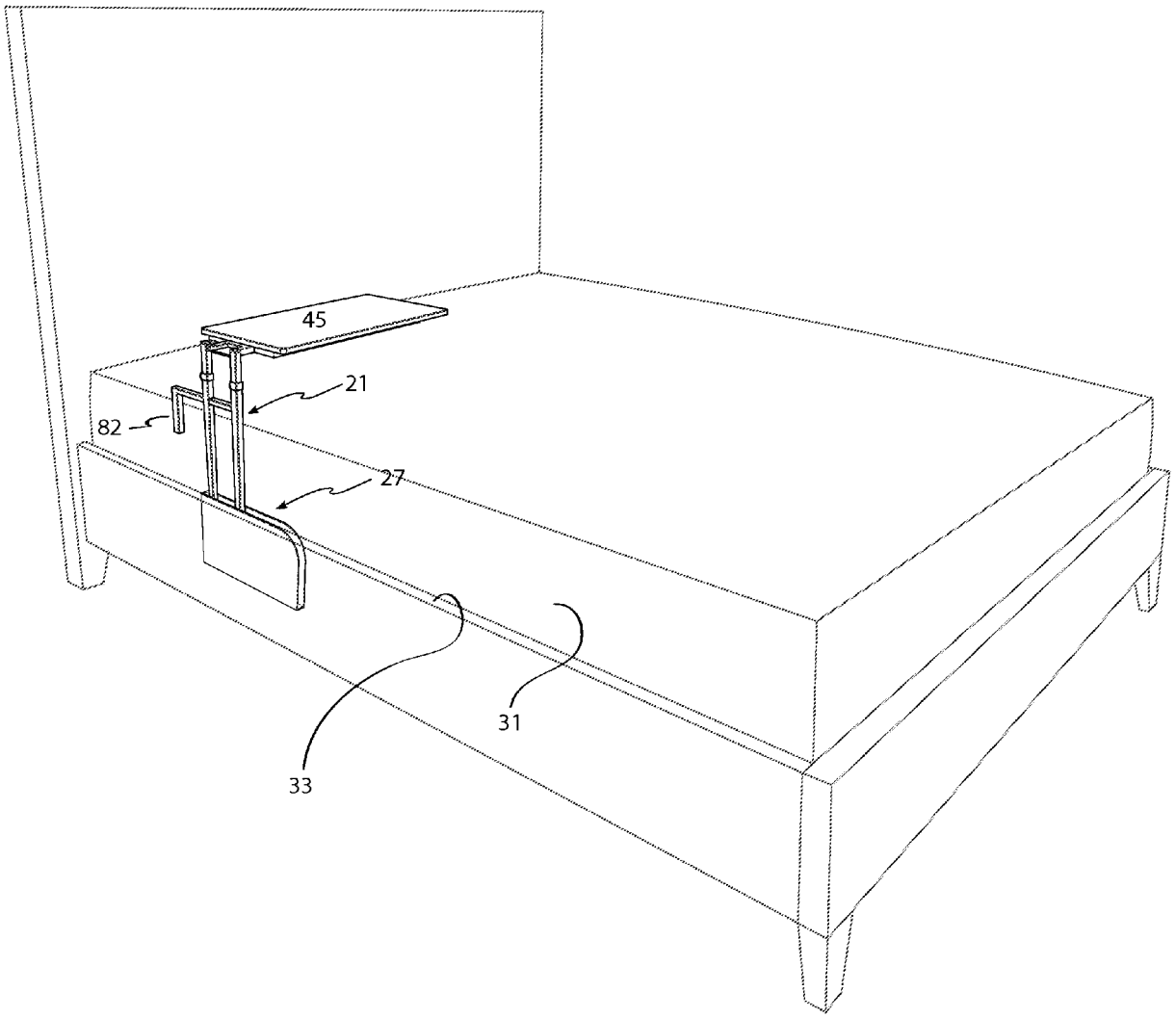
FIG. 1 is a perspective view of the retrofit table device of the present invention mounted to the space between a side of a mattress and the side rail of a bed.
Figure 3:
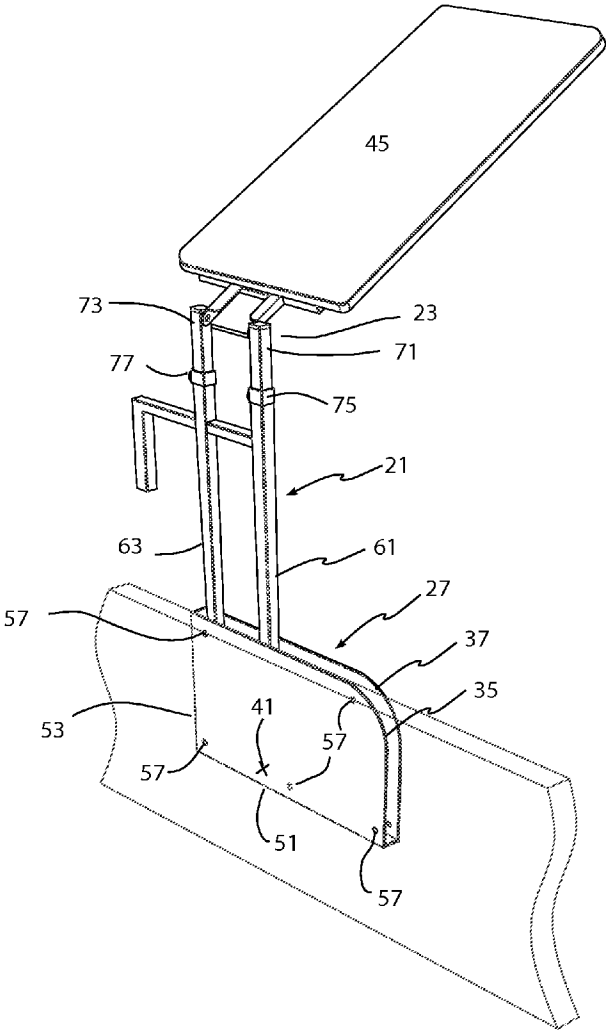
FIG. 3 is a sectional view taken in along the line of 33 of FIG. 2.
Figure 4:
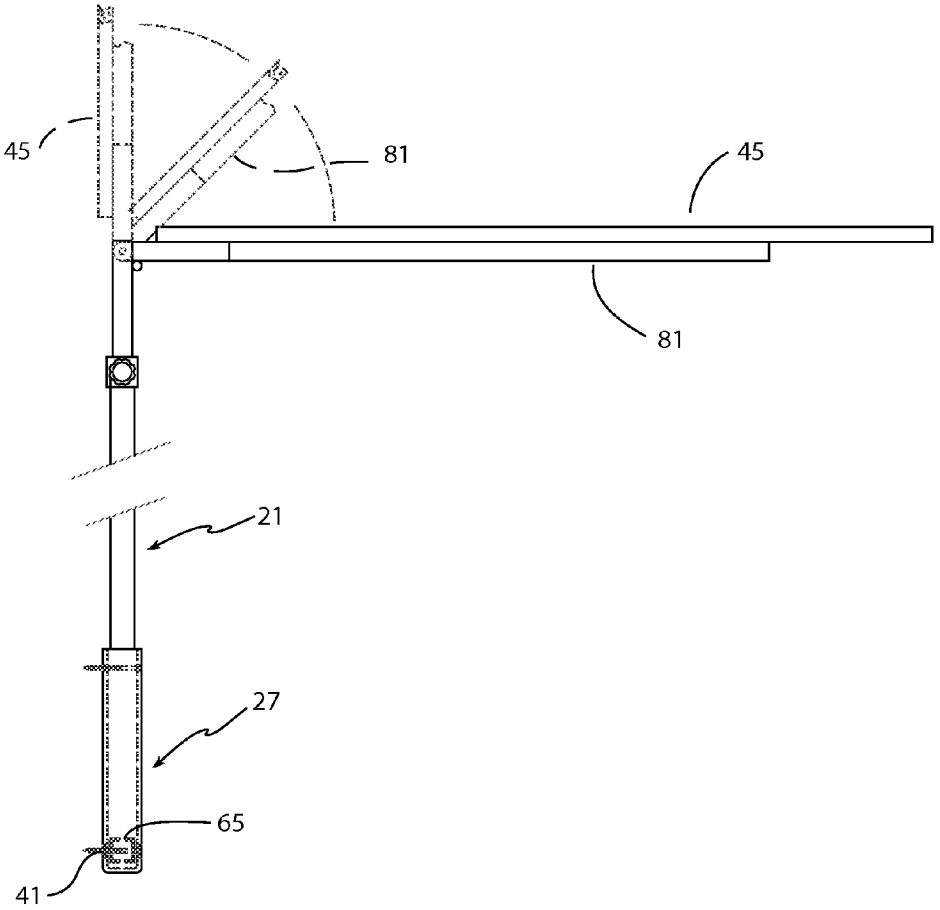
FIG. 4 is a sectional view taken from inside a rail of a bed similar to a bed similar to FIG. 1 but with the table device reversed relative to the position shown in FIG. 1, in enlarged scale.

Referring to FIGS. 1 and 3, the retrofit bed table device of the present invention includes, generally, an elongated stem or stand 21 configured with upper and lower extremities 23 and 25. A narrow mounting device in the form of a box, generally designated 27, is fitted into the narrow space between the side of a cushion device like a mattress 31 and the inside surface of a frame member identified as a rail 33 and is configured with opposite side walls 35 and 37 to receive the stand in close fit relationship. The forward side of the stand 21 at the lower extremity is connected with the box 27 by means of a pivot pin 41 so that the stand may be pivoted between the lower position shown in FIG. 5 and the raised position shown in FIG. 1. A table top 45 is pivotally connected to the upper extremity 23 of such stand.

With the aging of the American population, the need for convalescence is expected to grow significantly in the coming years thus fueling an interest in devices making convalescence more comfortable the older population. Persons 65 years and older was counted at 40 million in 2009 representing almost 13% of the US population. By 2030 it is projected that there will be about 72 million older persons, more than twice the number in 2000. Thus it would be expected that there will be more convalescence with patients confined to a bed.

There are millions of conventional or hospital beds presently in use which might be used for certain periods of time while patients are bedridden. While numerous devices have been proposed for use with beds of this type to facilitate serving meals to the patient and the like, to date none have been proposed which provide a convenient retrofit apparatus which can be inexpensively manufactured and conveniently installed in existing beds to provide a sturdy support for a table top which may be loaded with food and related materials having some significant weight and which are often loaded unevenly on the table top. It is this need for a device to retrofit beds to provide a convenient and sturdy mechanism for serving the patient's meals and the like which is solved by the present invention.

Figure 6:
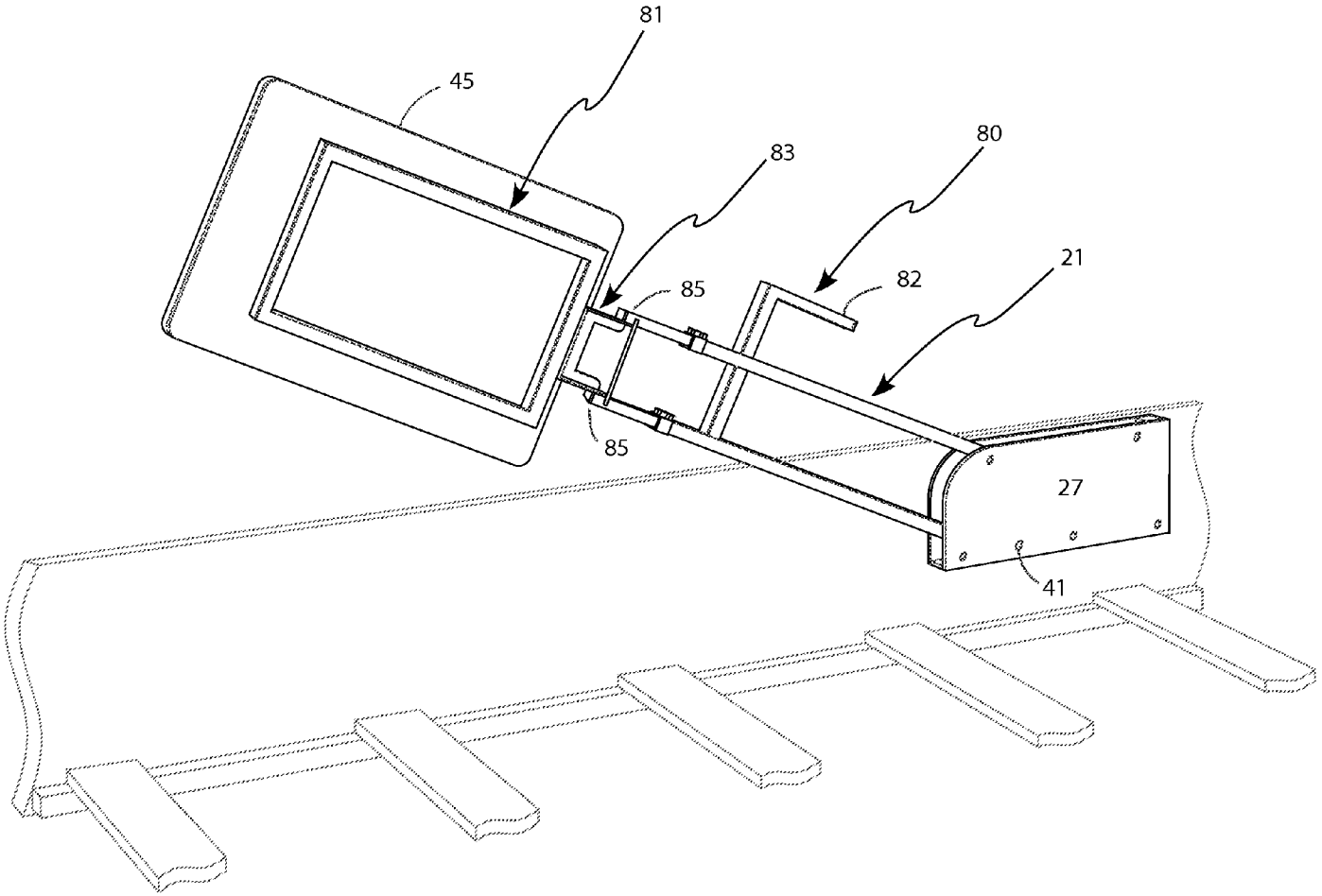
FIG. 6 is a sectional view similar to FIG. 5 but showing the table stand in a partially raised position.

Typically, in the preferred embodiment, my device is constructed of metal or plastic or the like. Referring to FIGS. 1 and 6, the mounting box 27 is conveniently formed of sheet metal and I have found that an overall depth of about 1¼ inches will conveniently fit in the space between the inside of the bed side rail surface 33 and side of the mattress 31 to provide for convenient installation and sturdy support. In practice, the box is approximately 10 inches high and 16 inches long to provide a relatively sturdy construction. I have found that a width of between ¾ and 1½ inch is sufficient to fit most commercially available beds and to provide the necessary clearance for free movement of the stand. In the preferred embodiment, the box is formed with a bottom wall 51 and front wall 53 to add rigidity to the box itself. The configuration of the side walls, bottom wall 51 and front wall 73 leaves the top side and rear side open.

Referring to FIG. 3, the walls of the box are formed with a plurality of through clearance bores for receipt of respective fasteners 57 to secure the back wall of such box securely to the bed side rail.

Figure 7:
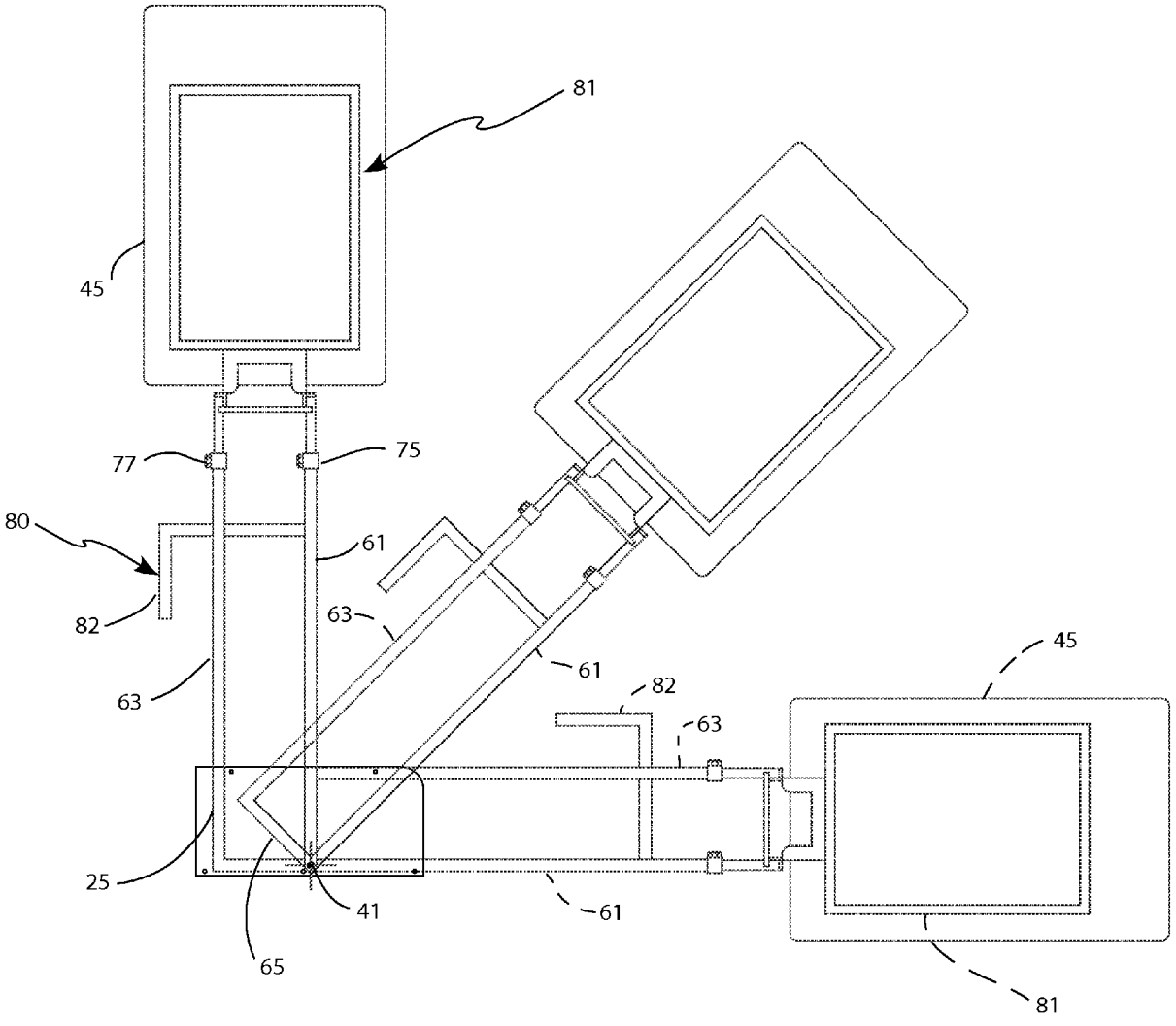
FIG. 7 is a partial sectional view similar to FIG. 6 and showing the table being raised from its retracted position to its erect position.

For my preferred embodiment, I have constructed my stand 21 with an adjusted height of between 2 and 3 feet and a width of approximately 7 inches to provide a sturdy support and a cooperative relationship with the box to afford extra support for the stand itself. For the preferred embodiment I have selected a pair of female square stem tubes 61 and 63 having a cross section of about 1 inch and a cross rung 65 connecting the lower ends of such tubes, the juncture between the rung 65 and tube 61 being configured with the pivot bore for receipt of the pivot pin 41 (FIG. 3). As will be appreciated by those skilled in the art, the stand 21 thus pivots about the pivot pin 41 as the opposite side of the stand at the end of the bottom rung 65 (FIG. 7) acts as a follower tracing a circular path having a diameter of about 7 inches as the stand is rotated between its lowered horizontal position to its erect position. In practice, I construct the mounting box with only about ⅛ inch space between the opposite sides of the stand 21 and the front and back walls 35 and 37 to thus provide for free rotation of the stand while affording positive support against the top of the stand tilting inwardly or outwardly from the erect position shown in FIG. 1, even as the top of the table 45 is loaded. Furthermore, in the erect position, the lateral extent of the stand supported in the box 27 provides support against twisting of the stand within the confines of the walls 35 and 37 to thereby prevent rotation of the table 45 in the horizontal plane even if the distal free end should be bumped (FIG. 1). In practice I have found that a clearance between the sides of the stand of between 1/32 of an inch and ⅜ of an inch serves to provide the necessary clearance for free rotation while affording the necessary support for the stand to prevent tilting and twisting under normal loads.

Referring to FIG. 3, I provide my stand 21 with a pair of square male tubes 71 and 73 telescoped downwardly into the female tubes 61 and 63 and configured so that the extent of telescoping thereof can be controlled by means of respective adjustable collars 75 and 77 which include thumb screw fasteners to adjust the compression thereof for controlling the relative movement of the extension tubes 71 and 73 relative to the female tubes 61 and 63

Referring to FIG. 6, in one preferred embodiment I provide a square tubular frame, joint designated 81 to support my table top 45. In this embodiment, I include a connector yoke, generally designated 83, which is connected with the upper extremities of the tubes of the stand by means of pivot pins 85 for rotation of the table top between its retracted position disposed in the extended plane of the stand and its work position as shown in FIG. 1. For my preferred embodiment, I have incorporated a handle 81 attached to the stand and configured in the form of a L-shaped crank formed of square tubing and configured with a handle 82.

In operation, it will be appreciated that the retrofit table top apparatus of the present invention can be conveniently packaged in a shipping package for inventorying by a retail outlet or shipping to customers of a website and upon receipt, the installation will be relatively straightforward. As an example, the apparatus may be retrofitted to a bed by merely positioning the mounting box 27 on the inside surface 33 of the bed rail and positioned forwardly or rearwardly along the rail to the location most convenient to the patient intended to rest on the mattress 31. Fasteners may then be inserted through the pre-drilled bores 57 in the box 27 to secure the box in position on the rail and oriented with the open sides facing upwardly and rearwardly. The table 45 will then be in position for ready use or storage, supported in its raised position against the top of the stand 21 tipping inwardly as the table is loaded and against twisting should the free end of the table be bumped.

Figure 5:
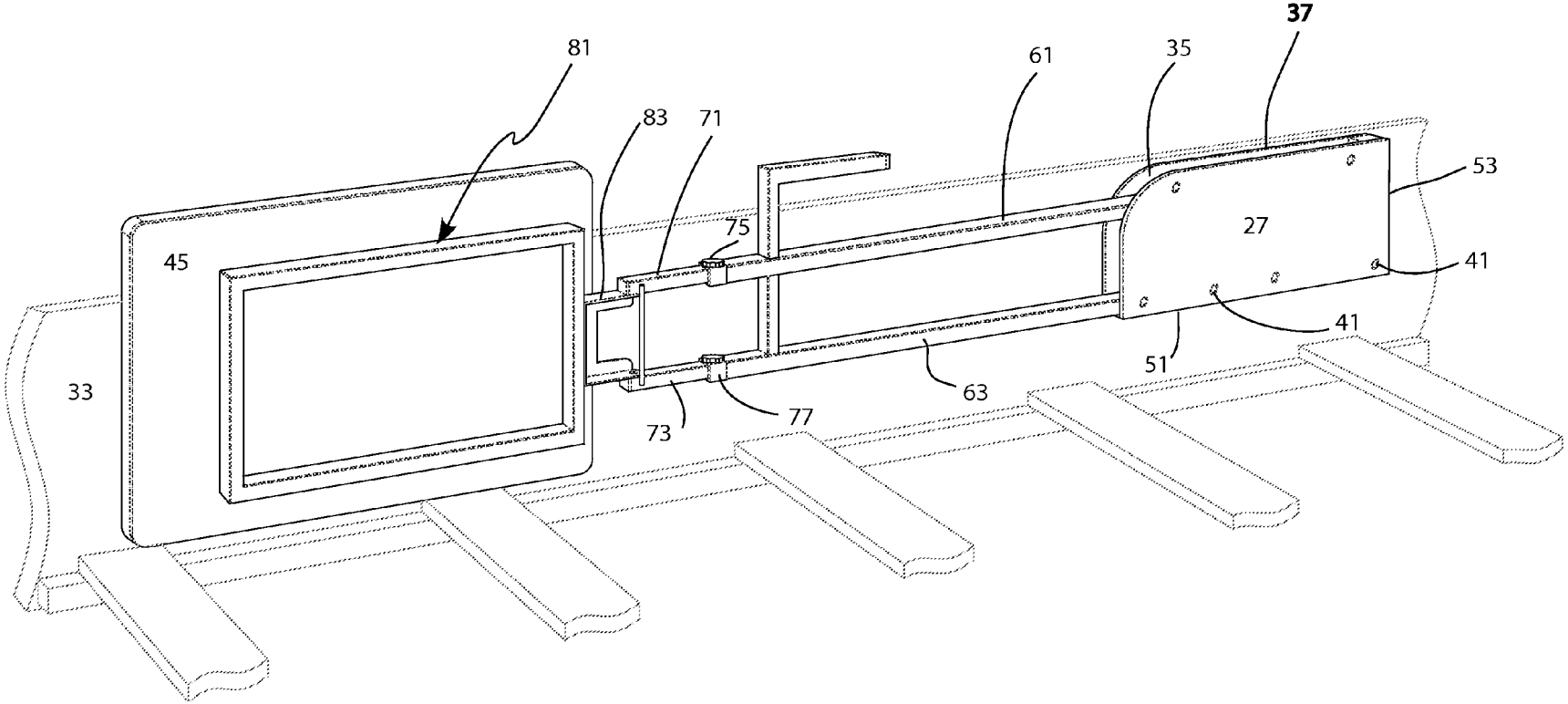
FIG. 5 is sectional view similar to FIG. 4 but with the table device in a partially raised position.

To be stored, the table will be rotated about the pivot pins 85 to its extended position co-extensive with the plane of the stand 21 as shown in FIG. 5 to be rotated downwardly along the inside surface 33 of the bed rail. When it is desirable to deploy the table top 45, the workman will grasp the handle 80 to draw the stand 21 upwardly about the pivot pin 41 as the following opposite side of the stand traces a circular pattern within the box as supported against relative movement and flexing.

As noted, when the stand 21 is rotated to the vertical position shown in FIG. 3, it will be appreciated that the side walls 35 and 37 of the box afford rigid support for the lower portions of the stems 61 and 63 of the stand to provide support against torqueing and flexing relative to the box to thereby provide a positive and rigid support for the stand and, consequently, the table 45 as it is deployed to its horizontal position as shown in FIG. 1.

Then, as the table top 41 is loaded with materials, such as, for instance, a newspaper, drinking water, a breakfast meal and other possible weights such as photographs of loved ones and the like, the table top will be firmly supported by the stand 21 as constrained within the walls 35 and 37 of the box 27 and supported by the rigid underframe 81.

Figure 2:
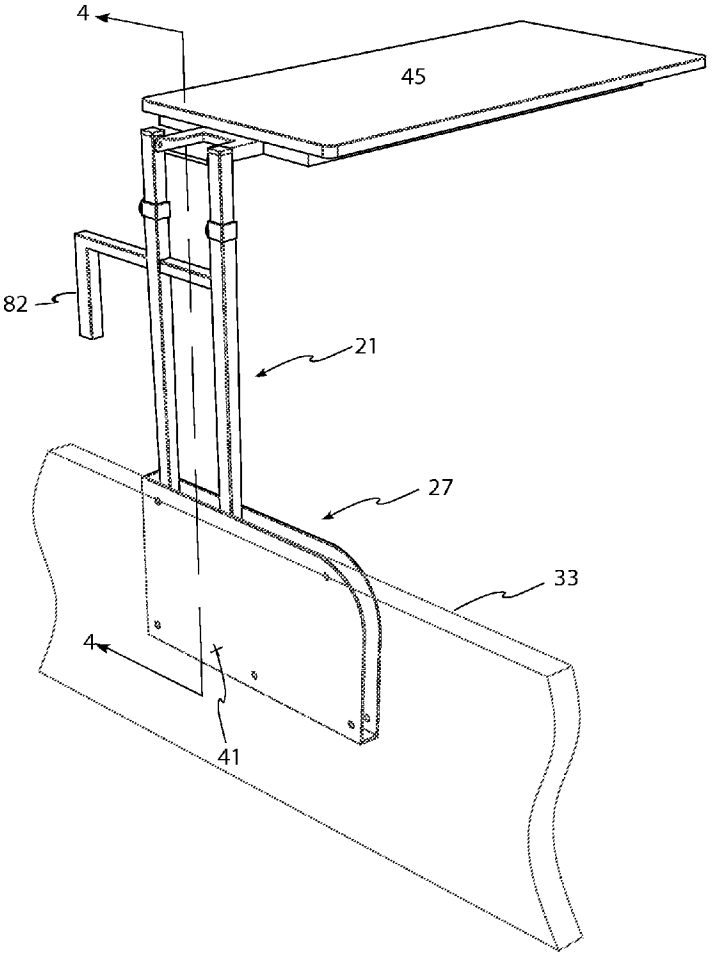
FIG. 2 is a partial perspective view similar to FIG. 1 but in enlarged scale.
Figure 8:
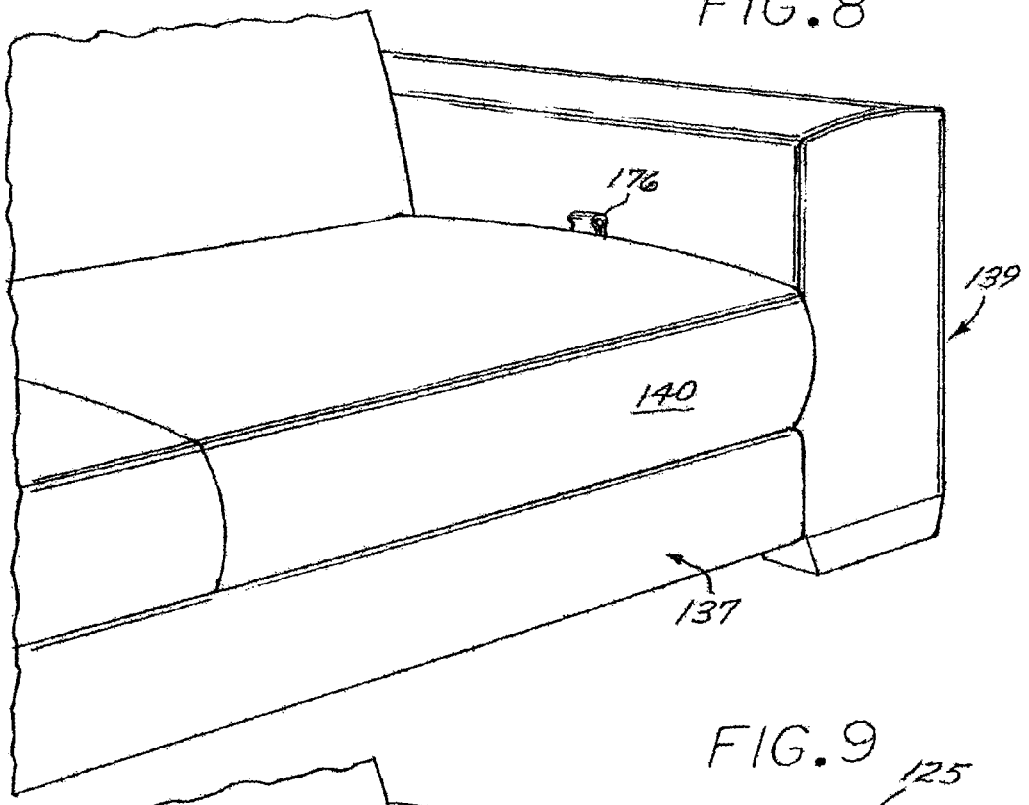
FIG. 8 is a partial perspective view of a sofa to which the retractable table device of the present invention has been retrofitted and depicted the device in its retracted position.
Figure 9:
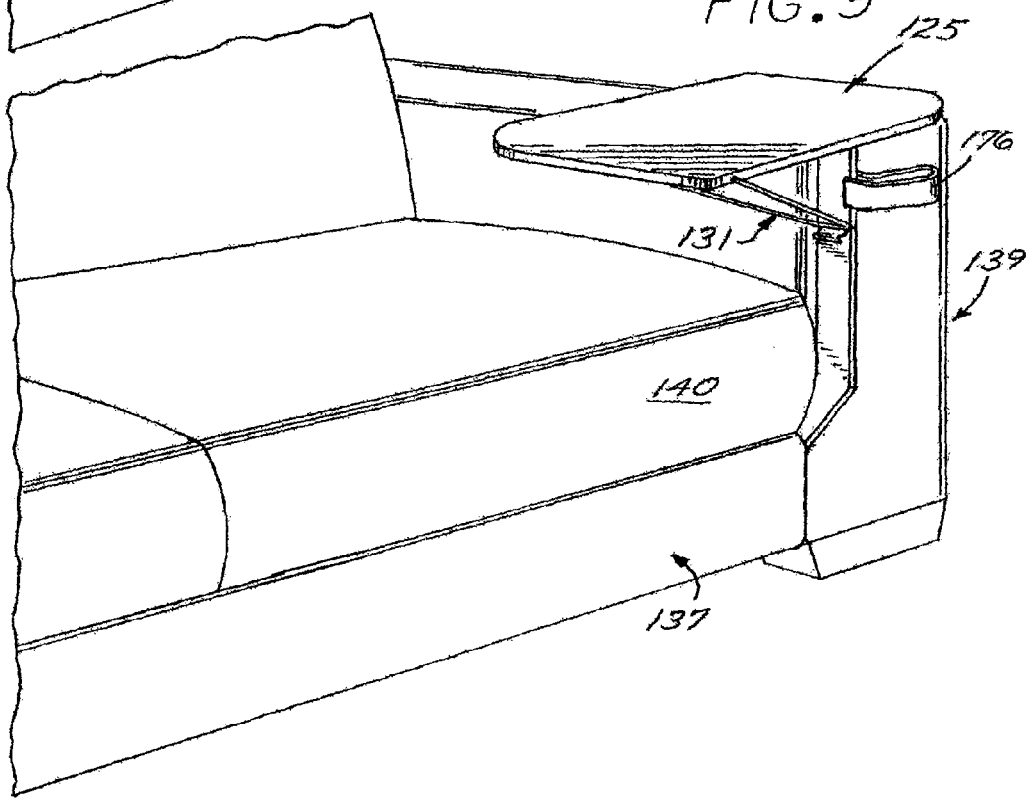
FIG. 9 is a perspective view similar to FIG. 8 but depicting the retractable table device in its working position.

Referring to the second embodiment of the present invention shown in FIGS. 8, 9 and 13, the retrofit retractable table device of the present invention includes, generally, a mounting bracket 121 pivotally mounting one end of an elongated, thin stem 123 which pivotally mounts a table 125 at the free extremity thereof for rotation between a retracted position shown in FIG. 3 disposed in the extended plane of the stem 123 and the working position disposed perpendicular to the plane as shown in FIG. 2. A latch, generally designated 131, is pivotally carried from the table and engage a notch 133 in the stem to latch the table in its working position as shown in FIG. 16. As will be appreciated by those skilled in the art, while my present invention has particular utility as a retrofit table, it will also be incorporated in originally manufactured sofas chairs and the like.

As leisure time has become more available and sometimes schedules more compressed, it has been common to utilize sofas or the like both for rest and pleasure as well as a working site or sometimes dining to conserve time and possibly multitask by watching, for instance, television while eating lunch or dinner. It is thus desirable to have a retractable table device which is convenient to retrofit directly to the sofa and configured and arranged so that during nonuse, it can be conveniently concealed in a retracted position but yet readily available to deploy to position the table in a working position for supporting a user's workload, reading or food containers and utensils.

Referring to FIG. 9, it is recognized that the space between a support frame, generally designated 137, and the interior surface of a sofa arm 139 and its support is relatively narrow, maybe open to just and couple of inches when the cushion support is pressed away from the arm frame member 150 (FIG. 11), and presents limited space for retrofitting a retractable table device in place without major reconfiguration of the support frame or sofa arm. In that regard, for this disclosure I intend the term cushion to encompass the cushion support, it being appreciated by the reader that my device will normally be mounted flanking the cushion support but may also be mounted flanking the cushion itself.

Figure 10:
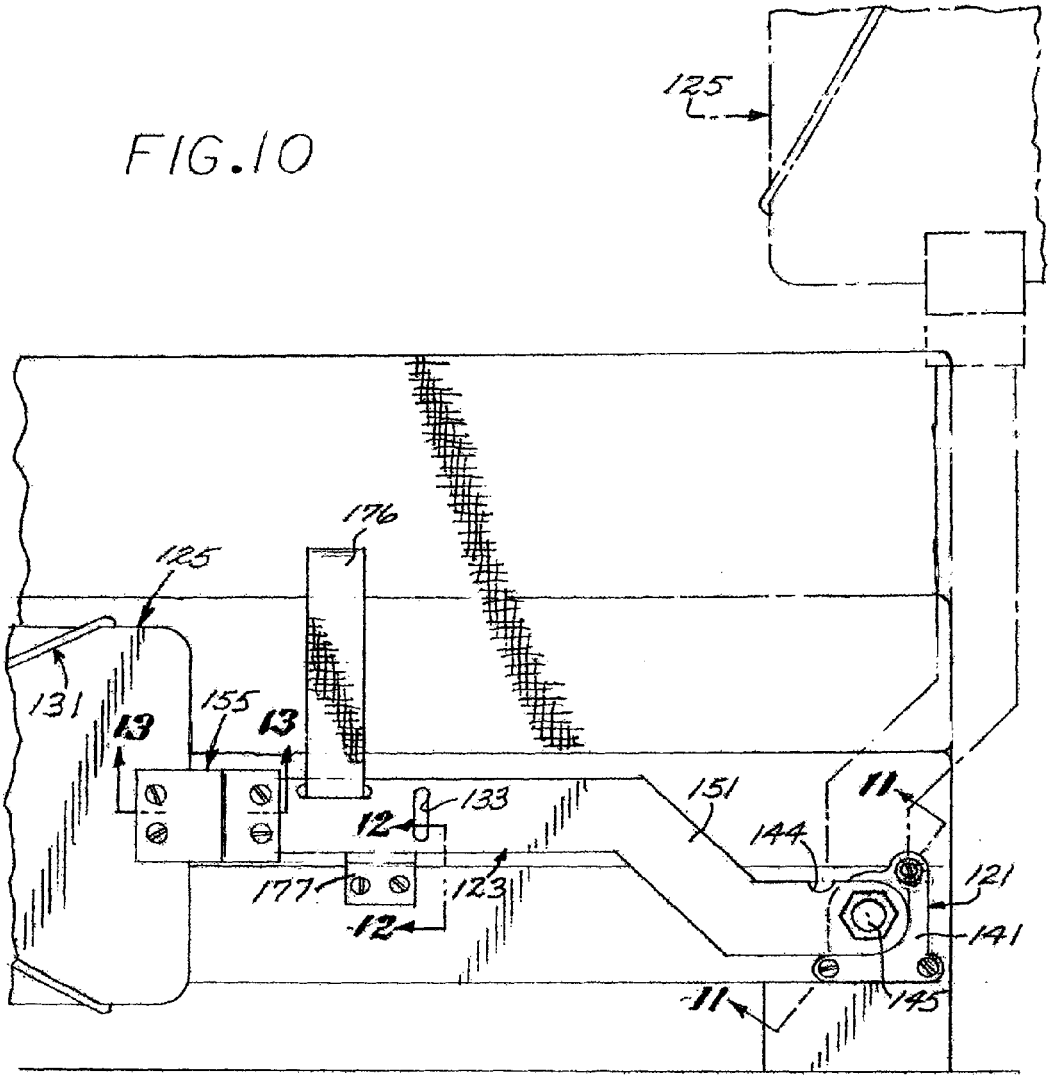
FIG. 10 is a transverse, sectional view, in enlarged scale, of the sofa shown in FIG. 8 and depicting the retractable table device in its retracted position.
Figure 11:
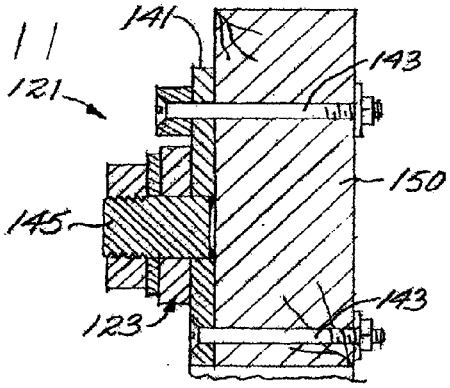
FIG. 11 is a transverse, sectional view, in enlarged scale, taken on the line 11-11 of FIG. 10.

Referring to FIGS. 10 and 11, the mounting bracket 121 conveniently includes a planar mounting plate 141 formed with bores for receipt of mounting bolts 143. The plate mounts a pivot pin 145 projecting through a bore in the proximal extremity of the stem 123.

The mounting device includes a stop 142 which, in this embodiment, is in the form of a cylindrical spacer mounted to the head of a mounting screw 142 and positioned by the predrilled bores in the plate 141 so as to be disposed in the path of the stem to be abutted by the a notch 144 (FIG. 10) formed in the leading edge of such stem to stop it in the erect position.

Referring to FIGS. 9 and 14, the stem 123 is formed medially with an offset 151 to, in the vertical position, dispose the upper portion of such stem displaced in a vertical plane forwardly of the pivot pin 145 to thereby dispose the center of gravity of the table forward of such pivot pin so the weight of the table and any load thereon will be stable.

The stem 123 is formed centrally with the lateral notch 133 in the form of a horizontal slot for selective receipt of the abutment end of the latch 131 to abut against the lower side of the slot.

The table 125 is mounted from the distal, free extremity of the stem 123 by means of a hinge assembly, generally designated 155, which includes a rightward opening clevis 157 (FIG. 13) formed with an open ended, transverse slot for receipt of the end of the stem 123 and is further configured with a second left opening clevis 159 for receipt of the end of the table 125, both held in position by respective set screws 161 and 163. The respective clevis devices 157 and 159 pivot about a transversely projecting, single axis, pivot pin 165.

The latch is conveniently formed by means of a robust wire device 171 of triangular shape and formed at its open extremity with journals 173 (FIG. 14) received in bores formed in opposite sides of the table.

The stem is further formed adjacent the table with a vertical slot 168 for receipt of a handle strap 176 (FIG. 10).

Figure 12:
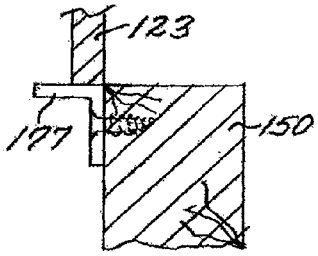
FIG. 12 is a vertical, sectional view, in enlarged scale, along line 12-12 of FIG. 10.

Referring to FIGS. 10 and 12, an angle stop 177 is mounted to the support frame and disposed in the downward path of the stem 123 as it rotates to its retracted position to thus support the free extremity of such stem in the horizontal position as shown in FIG. 10.

For the purpose of this disclosure, the sofa itself may be in the form of an easy chair, bed or the like, it being realized by those skilled in the art that the support frame may be a support frame for a bed and the space between the cushion 140 and the arm 139 may be spaced between the side of a mattress and a bed rail.

Also, for the purposes of this disclosure, the stem 123 is relatively thin, i.e. sufficiently thin, as about $1/8^{th}$ of an inch, so it may be easily received, either freely, or by pressing it into place between the edge of the sofa cushion and interior side of the sofa arm 139 to be jammed downwardly into the retracted position shown in FIG. 10. Additionally, the term sofa and sofa apparatus as used herein is intended to encompass any sofa, chair or bed including a side rail, side arm or the like and cushion or mattress closely spaced to allow for installation and operation of the device of the present invention.

In operation, it will be appreciated that the retractable table device of the present invention may be sold as a kit so the user can easily install the device on an existing sofa, easy chair or bed. That is, the user may merely drill bores in the arm rest frame 150 for receipt of the mounting bolts 143 (FIG. 10) or possibly utilize threaded screws to mount the bracket in place to support the stem 123. The stem will thus be supported in place and ready for use.

To rotate the device to its retracted position, the user will raise the free end of the table from the horizontal position shown in FIGS. 9 and 15 to be disposed in the extended plane of the stem 123 as shown in FIG. 10 and retract the latch 131 against the underside of the table. In some embodiments I incorporate a latch to latch the brace defining the latch 131 flat against the underside of the table. The stem and table may then be rotated to the retracted position driven downwardly into the space between the support frame and the inside surface of such arm until the free extremity of the stem 123 rests on the stop 177 (FIG. 12). At this point the table will be concealed from view and protected from dirt and debris to which the underside of the sofa might be exposed and from any household pets or pests who might be exploring underneath the sofa.

Then, when the user decides to utilize the table device for a work surface or dining, he or she may grasp the hand grasp strap as shown in FIG. 8 to raise the distal end of the stem to rotate it about the pivot pin 145 to be stopped in its vertical position when the notch 144 engages the stop 140 as shown in FIGS. 9, 14 and 15, it being realized that the offset 151 serves to dispose the center of gravity for the table and any load thereon in a vertical plane forwardly of the pivot pin 145 to thus maintain the stem in its vertical position by the influence of gravity. The free extremity of the table may be lowered to its position extending perpendicular to the stem and the latch 131 rotated to engage the abutment 151 within the slot 123 (FIGS. 14 and 16) to support the table and its working position.

From the foregoing it will be appreciated that the retrofit table device of the present invention provides an economical and convenient means for installing a table device in a sofa, easy chair, bed or the like for convenient use and to provide sturdy support for loads of various sizes and weights.

Although the present invention has been described in detail with regard to the preferred embodiments and drawings thereof, it should be apparent to those of ordinary skill in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention.

I claim:

1. A retractable table device for mounting at a selected location on a support frame to fit in the narrow space between the side of a cushioning device and a frame member of a sofa or bed and comprising:

a mounting device for mounting from the frame;

a thin planar stem for mounting on one extremity from the mounting device for rotation from a horizontal, retracted position disposed in the space to a vertical position and terminating in a free upper extremity;

a pivot device for mounting the one extremity from the mounting device;

a table for mounting to the free upper extremity and pivotable between a retracted position disposed in the plane of the stem and a working position perpendicular to the plane of the stem;

a hinge mounting the table to the free upper extremity;

a latch interposed between the stem and table operable to latch the table in the working position.

2. The retractable table device of claim 1 wherein:

the stem is in the form of an elongated, flat metal strap.

3. The retractable table device of claim 1 wherein:

the stem is formed with an offset to, when installed and the stem is in its vertical position, dispose the free upper extremity forwardly of the mounting device.

4. The retractable table device of claim 1 wherein:

the mounting device includes a mounting plate to mount to the frame and a horizontally extending pivot pin for mounting the one extremity of the stem for rotation thereabout.

5. The retractable table device of claim 1 wherein:

the stem is formed medially with an abutment; and the latch includes a base pivotally carried from the table at a location spaced from the hinge and having an abutment end for selectively engaging the abutment.

6. The retractable table device of claim 1 that includes:

a handhold strap carried from the stem.

7. The retractable table device of claim 1 that includes:

a stop mounted from the frame and positioned for stopping downward rotation of the stem in its retracted position.

8. A retractable table device for mounting in the narrow space formed between a cushion and arm frame of a sofa or easy chair comprising:

a mounting bracket for mounting adjacent the front of the frame;

a planar, rigid, thin strap defining a supporting stem and formed with a first extremity to be carried pivotally from the mounting bracket and terminating at its opposite extremity in a free end;

a table for mounting on one end to the free end for rotation between a retracted position projecting in the plane of the stem and a working position extending perpendicular to the plane of the stem; and a latch interposed between the table and stem for latching the table in its working position.

9. The retractable table device of claim 8 wherein:

the stem is formed with an offset to, when in a vertical position, dispose the table offset forwardly from the vertical plane through the mounting bracket.

10. The retractable table device of claim 8 that includes:

a hinge device for mounting the table from the stem for pivoting of the table about a single pivot axis.

11. The retractable table device of claim 8 that includes:

a stop for limiting rotation of the stem forwardly of the vertical position.

12. The retractable table device of claim 11 wherein:

the stop includes a mounting bolt mounting the bracket.

13. Sofa apparatus and retractable table device comprising:

a sofa device carried by a frame supporting a side arm;

a mounting bracket mounted forwardly on the frame;

a thin planar stem having one extremity pivotally mounted from the bracket and projecting therefrom to terminate in a free extremity and configured to rotate between a vertical position and a horizontal position disposed in the space between the sofa frame and arm;

a table carried pivotally from the free extremity and pivotable between a retracted position disposed in the plane of the stem and a working position perpendicular to the plane of the stem; and a latch device for selectively latching the table in the working position.

14. The sofa apparatus and retractable table device of claim 13 wherein:

the stem is formed with an offset to, when in its vertical position, dispose the table forwardly of vertical plane through the mounting bracket.

15. The sofa and retractable table apparatus of claim 13 wherein:

the stem is formed medially with a notch; and the latch includes a brace from the table end having an abutment and configured to engage in the notch when the table is in its working position.

16. Retractable table apparatus for mounting to a frame supporting a cushion device to form a narrow space between the side of the cushion device and a frame member and comprising:

a mounting device for mounting to the frame;

an elongated stem pivotally mounted on one end to the mounting device, formed on the opposite end with a free extremity and constructed to, when the mounting device is mounted to the frame member, be pivoted through a predetermined path from a horizontally disposed retracted position in the narrow space to a vertical erect position;

the mounting device including first and second stops disposed in the predetermined path to, be engaged by the stem to stop pivoting in the respective retracted and erect positions; and an elongated table pivotally connected on one extremity thereof to the free extremity for pivoting between a retracted position projecting longitudinal of the stem and a working position projecting perpendicular to the stem; and a latch for latching the table in the working position.

17. The retractable table apparatus of claim 16 wherein:

the stem is formed with an offset to, when the stem is in the erect position, dispose the center of gravity of the table forward of the pivot to thereby cause the weight of the table to tend to hold the stem in its erect position.

18. The retractable table apparatus of claim 16 wherein:

the latch is in the form of a formed wire configured of a triangular shape with one side of the triangle being open and formed with in-turned journal elements; and the table is formed on its opposite sides with bores for receipt of the journal elements.

19. The retractable table apparatus of claim 16 wherein:

the mounting device includes a pair of laterally spaced apart, parallel walls cooperating to define an upwardly opening cavity; and the stem is formed with a lower extremity constrained by the parallel walls.

20. The retractable table apparatus of claim 16 wherein:

the elongated table is pivotally connected to the free extremity for pivoting about an axis transverse to the stem to, in the retracted position, project longitudinally from the stem.

21. Retractable table apparatus for mounting to a frame supporting a cushion device to form a narrow space between the side of the cushion device and a frame member and comprising:

a mounting device to be disposed in the narrow space for mounting to the frame;

an elongated stem to be pivotally mounted on one end to the mounting device, formed on the opposite end with a free extremity and constructed to, when the mounting device is mounted to the frame member and the one end pivotally connected thereto, be pivoted through a predetermined path from a horizontally disposed retracted position in the narrow space to a vertical erect position projecting up from the narrow space;

the mounting device including first and second stops disposed in the predetermined path to, respectively be engaged by the stem to stop pivoting in the retracted and erect positions; and an elongated table pivotally connected on one extremity to the free extremity for pivoting between a retracted position disposed in the plane of the stem and a working position projecting perpendicular to the stem; and a latch for latching the table in the working position.

* * * * *